US007753370B2

(12) United States Patent
Inoue

(10) Patent No.: US 7,753,370 B2
(45) Date of Patent: Jul. 13, 2010

(54) SHEET CONVEYANCE APPARATUS, AND IMAGE FORMING APPARATUS AND IMAGE READING APPARATUS

(75) Inventor: Hiroshige Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 11/764,713

(22) Filed: Jun. 18, 2007

(65) Prior Publication Data

US 2007/0296141 A1 Dec. 27, 2007

(30) Foreign Application Priority Data

Jun. 22, 2006 (JP) ..... 2006-172660

(51) Int. Cl.
*B65H 9/00* (2006.01)

(52) U.S. Cl. ..... 271/239; 271/234; 271/249; 271/252; 271/236

(58) Field of Classification Search ..... 271/226–255, 271/272, 273, 274
See application file for complete search history.

(56) References Cited

U.S. PATENT DOCUMENTS

| | | | | |
|---|---|---|---|---|
| 5,078,384 | A * | 1/1992 | Moore | 271/228 |
| 5,219,159 | A * | 6/1993 | Malachowski et al. | 271/228 |
| 5,697,608 | A * | 12/1997 | Castelli et al. | 271/228 |
| 6,019,365 | A * | 2/2000 | Matsumura | 271/227 |
| 6,059,285 | A * | 5/2000 | Suga et al. | 271/228 |
| 6,155,561 | A * | 12/2000 | Mandel | 271/254 |
| 6,173,952 | B1 * | 1/2001 | Richards et al. | 271/228 |
| 6,647,884 | B1 * | 11/2003 | La Vos et al. | 101/485 |
| 7,011,305 | B2 * | 3/2006 | Forch et al. | 271/226 |
| 7,404,557 | B2 * | 7/2008 | Tada et al. | 271/226 |
| 7,422,209 | B2 * | 9/2008 | Hashimoto | 271/228 |
| 7,537,210 | B2 * | 5/2009 | Kawaguchi | 271/226 |
| 7,540,496 | B2 * | 6/2009 | Fukushima | 271/253 |
| 7,607,660 | B2 * | 10/2009 | Inoue | 271/228 |
| 2005/0035536 | A1 * | 2/2005 | Suga et al. | 271/226 |
| 2007/0023995 | A1 * | 2/2007 | Onodera | 271/226 |
| 2007/0273091 | A1 * | 11/2007 | Kamiya et al. | 271/233 |

FOREIGN PATENT DOCUMENTS

| | | |
|---|---|---|
| JP | 59-004552 A | 1/1984 |
| JP | 3-094275 A | 4/1991 |
| JP | 4-277151 A | 10/1992 |

* cited by examiner

*Primary Examiner*—Patrick Mackey
*Assistant Examiner*—Prasad V Gokhale
(74) *Attorney, Agent, or Firm*—Canon U.S.A., Inc. I.P. Division

(57) ABSTRACT

A sheet conveyance apparatus provides skew correction roller pairs which rotate a sheet while conveying the sheet to correct skew of the sheet, and lateral registration roller pairs which moves the sheet in a direction orthogonal to the sheet conveyance direction to correct the lateral registration. When the lateral registration is corrected, assist roller pairs arranged downstream is moved in the same direction as the lateral registration roller pairs in synchronization with the lateral registration roller pairs.

15 Claims, 17 Drawing Sheets

SHEET CONVEYANCE APPARATUS, AND IMAGE FORMING APPARATUS AND IMAGE READING APPARATUS

BACKGROUND OF THE INVENTION

1. Field of the Invention

The present invention relates to a sheet conveyance apparatus with which image forming apparatus such as copiers, printers and facsimile machines and image reading apparatus such as scanners are equipped.

2. Description of the Related Art

Recently, in image forming apparatus, together with a request for high productivity (a number of sheets on which an image can be formed per unit time) and miniaturization of devices, a request that skew and displacement of a sheet is corrected with high precision to improve image quality, is also increasing. Further, sheets to be conveyed in sheet conveyance apparatus have various thickness from heavy paper to thin paper, various sizes from a small size of a post-card size to a large size such as 330 mm×488 mm, and have various paper quality such as coated paper and embossed paper, in addition to plain paper.

In order to achieve high productivity, firstly, a distance between conveyed sheets (a distance between the rear edge of the preceding sheet and the leading edge of the following sheet) needs to be reduced as much as possible. When the distance between the sheets is reduced, skew and displacement that occur in feeding a sheet have to be corrected in a short time.

Therefore, a method of correcting the skew while a sheet is conveyed has been proposed. The method uses a skew correction unit for correcting the skew of a sheet instead of a conventional method in which skew is corrected by abutting the leading edge of a sheet onto a nip of a stopped roller pair. This technique is disclosed in Japanese Patent Application Laid-Open No. 4-277151.

The skew correction method is a so-called active registration method, and has, for example, a configuration as shown in FIG. 16 in which two sensors 500*a* and 500*b* are arranged in a direction (sheet width direction) orthogonal to a sheet conveyance direction (a sheet moves from the left to the right in the figure), and the sensors 500*a* and 500*b* detect the leading edge of the conveyed sheet S. Then, a skew amount of the leading edge of the sheet S is calculated based on a signal detected when the sheet S passes the sensors 500*a* and 500*b*. Thereafter, the skew of the sheet S is corrected according to the skew amount calculated by a skew correction roller pair 504*a* and 504*b*. The skew correction roller pair 504*a* and 504*b* is arranged on the same axis in the sheet width direction at a predetermined interval, and drive of the roller pair 504*a* and 504*b* is independently controlled by motors 502*a* and 502*b*. In this way, the skew can be corrected even if a distance between sheets is small.

As a conventional method of correcting displacement in the sheet width direction, a configuration is proposed in which a registration roller pair is moved in a thrust direction to correct the lateral registration position of a sheet. This technique is described in Japanese Patent Application Laid-Open Nos. 59-4552 and 3-94275.

An image forming unit is normally arranged downstream from a registration roller pair. A sheet held between the registration roller pair is moved in the thrust direction to correct the lateral registration position by the time the sheet is conveyed to the image forming unit. In this case, when the rear edge of the sheet passes through the registration rollers, the registration rollers must be returned to their initial positions to prepare for the following sheet. If the distance between conveyed sheets is small, control is performed such that the registration roller pair conveys the sheet to the image forming unit, the registration roller pair is released from a nip after the leading edge of the sheet reaches the image forming unit, and the registration rollers are returned to their initial positions. In this way, lateral registration can be corrected even if a distance between sheets is small.

On the other hand, various basis weight of a sheet is required, which ranges from thin paper of about 50 g/m$^2$ to thick paper of 300 g/m$^2$ or more. The sheet size is also diversified into various kinds from a small size such as a post-card size to a large size such as 330 mm×488 mm. In order to correct the skew and displacement of a large, thick sheet having large inertia force with high precision, a conveyance load on a sheet needs to be reduced as much as possible. Typically, all conveyance rollers upstream from the skew correction roller pair 504*a* and 504*b* shown in FIG. 17 are released from a sheet and a conveyance guide is configured to be a straight path so that a conveyance load on a sheet is reduced.

However, a straight conveyance guide in a registration unit increases a size of the entire device. Accordingly, a bending conveyance guide needs to be arranged upstream of a registration unit in order to decrease the size of a device. In this case, if the skew correction and the lateral registration movement are preformed on a large, thick sheet having large inertia force and large bending rigidity, a large conveyance resistance is applied to the sheet from the bending conveyance guide. Therefore, sheet slippage occurs when skew correction is performed on the sheet so that precision in correcting skew and lateral registration deteriorates.

SUMMARY OF THE INVENTION

The present invention is to provide a sheet conveyance apparatus that can correct skew and displacement of various sheets with high precision using a low-cost configuration even in devices where a large conveyance resistance is applied to a sheet from a conveyance guide positioned upstream in a sheet conveyance direction.

According to an aspect of the present invention, a sheet conveyance apparatus is provided which includes a skew correction unit configured to rotate a sheet while conveying the sheet to correct skew of the sheet; a lateral registration correction unit which is arranged downstream from the skew correction unit, and moves the conveyed sheet in the direction orthogonal to the sheet conveyance direction to correct a sheet position; and a sheet conveyance assist unit which is arranged upstream from the skew correction unit, and moves the conveyed sheet in the direction orthogonal to the sheet conveyance direction, wherein after skew correction of the sheet is performed by the skew correction unit, the lateral registration correction unit moves the sheet in the direction orthogonal to the sheet conveyance direction, and the sheet conveyance assist unit moves the sheet in the direction orthogonal to the sheet conveyance direction in synchronization with movement operation of the sheet by the lateral registration correction unit.

Further features and aspects of the present invention will become apparent from the following detailed description of numerous exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
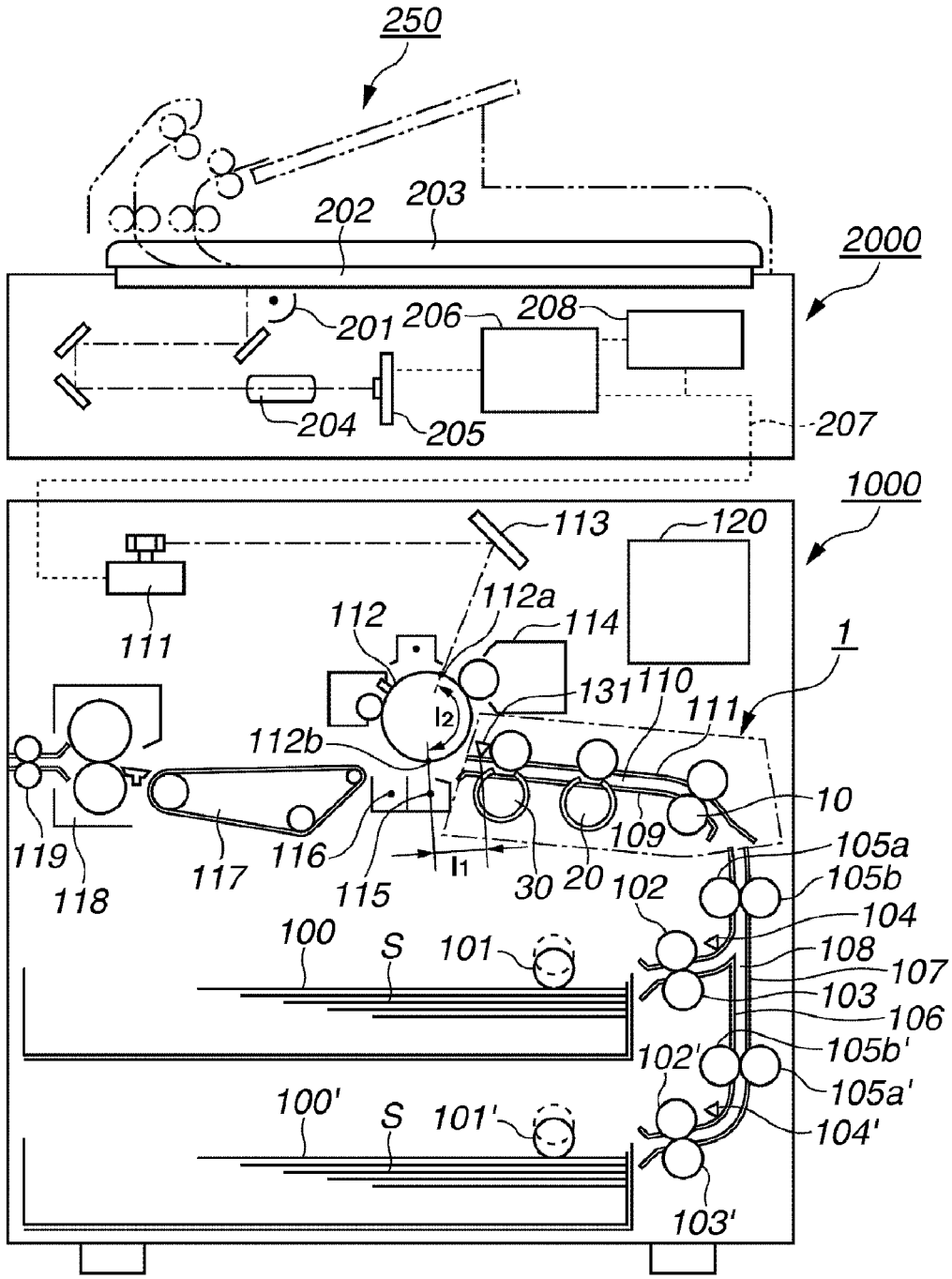
FIG. 1 is an overall view of an image forming apparatus including a conveyance apparatus according to a first exemplary embodiment of the invention.

FIG. 1 is a cross-sectional view of a printing apparatus serving as an image forming apparatus to which a registration device according to a first exemplary embodiment of the present invention is applied.

In FIG. 1, reference numeral 1000 denotes a printing apparatus, and a controller 120 controls the printing apparatus 1000. An upper cassette 100 stores sheets S. The sheets S stored in the upper cassette 100 are fed separately, one by one, by a sheet feeding unit including a pickup roller 101, which rises and falls or rotates at a predetermined timing, a feed roller 102 and a retard roller 103.

A sheet S fed from the sheet feeding unit is conveyed into a conveyance path 108, which includes guide plates 106 and 107, by a conveyance roller pair 105*a* and 105*b*. Then, the sheet S is conveyed to a registration unit 1. The registration unit 1 has a conveyance path 110 with a bending conveyance guide unit, which includes guides 109 and 111, assist roller pairs 10 (sheet conveyance assist unit), a skew correction roller pair 20 (skew correction unit), and a lateral registration roller pair 30 (lateral registration correction unit). The bending conveyance guide unit is arranged upstream in the registration unit 1. The skew of the sheet S is corrected (leading edge registration correction) and displacement in the width direction of the sheet S is corrected (lateral registration correction) in the registration unit 1, and then the sheet S is conveyed to an image forming unit.

The sheets S stored in a lower cassette 100' are fed separately, one by one, by a sheet feeding unit including a pickup roller 101', which rises and falls or rotates at a predetermined timing, a feed roller 102' and a retard roller 103'. Each sheet is conveyed along the conveyance path 108 to the registration unit 1 by a conveyance roller pair 105'*a* and 105'*b*.

Sheet detection sensors 104 and 104' detect a sheet fed from a sheet feeding unit. Based on a detection result by the sensors, the sheet S is controlled and conveyed to the registration unit 1.

The skew correction (leading edge registration correction) and displacement correction (lateral registration correction) in the registration unit 1 will be described in detail later.

The image forming unit will now be described. A photosensitive drum 112 rotates clockwise in the figure. A laser modulator (laser scanner) 111 forms an image. The laser light from the laser modulator 111 is bent by a mirror 113, and is applied to an exposure position 112*a* on the photosensitive drum 112 to form a latent image. The latent image is developed into a toner image by a developing device 114. A transfer charging device 115 transfers the toner image on the photosensitive drum 112 onto a sheet, and a separating charging device 116 electrostatically separates a sheet from a drum. Reference numeral 112*b* denotes a transfer portion in which a toner image on the photosensitive drum 112 is transferred onto the sheet S.

The leading edge of the sheet S that has passed through the registration unit 1 is detected by a registration sensor 131, and the sheet S is fed in synchronization with the image on the drum 112. The image is conveyed over a distance 12 from the laser light exposure position 112*a* of the photosensitive drum 112 to the transfer portion 112*b*. That is, the position of the sheet S is corrected while the sheet S is conveyed over a distance $l_1$ from the registration sensor 131 to the transfer portion 112*b*, where an image on the photosensitive drum 112 is transferred in synchronization with the leading edge of the sheet S.

A conveyance belt 117 conveys a sheet material on which an image is formed, and reference numeral 118 denotes a fixing device; and 119 a paper ejection roller. The sheet S onto which a toner image is transferred in the image forming unit is conveyed by the conveyance belt 117 and fixed by the fixing device 118. The sheet S is ejected to the outside by the paper ejection roller 119.

A scanner 2000 is placed on top of the printing apparatus 1000. In FIG. 1, reference number 201 denotes a scanning optical system light source, 202 a platen glass, 203 an openable document platen, 204 a lens, 205 a light receiving element (photoelectric conversion), 206 an image processing unit, and 208 a memory unit which stores image processing signals processed in the image processing unit.

A document image read by using the scanning optical system light source 201 is processed in the image processing unit 206 and encoded into electrical signals 207. The electrical signals 207 are transmitted to the laser modulator 111, which forms an image. Alternatively, the image information processed and encoded in the image processing unit can be once stored in the memory 208, and is transmitted to the laser modulator 111 in response to a signal from the controller 120 if needed.

While the printing apparatus 1000 and the scanner 2000 are described as independent devices in the exemplary embodiment, they can also be integrally configured. The printing apparatus 1000, which is independently or integrally configured with the scanner 2000, can function as a copier when a processed signal of the image forming unit is input to the laser modulator 111. On the other hand, the printing apparatus 1000 can also function as a facsimile machine when a facsimile signal is input, and function as a printing apparatus when an output signal of a personal computer is input. Adversely, when a signal processed in the image processing unit 206 is transmitted to another facsimile machine, the printing apparatus 1000 can also perform a facsimile function. Here, if an automatic document feeder 250 indicated by double-dashed dotted lines is mounted on the printing apparatus 1000 instead of the platen 203, a document can be automatically read. In this case, the scanner 2000 and the automatic document feeder 250 constitute the image reading apparatus.

Figure 2:
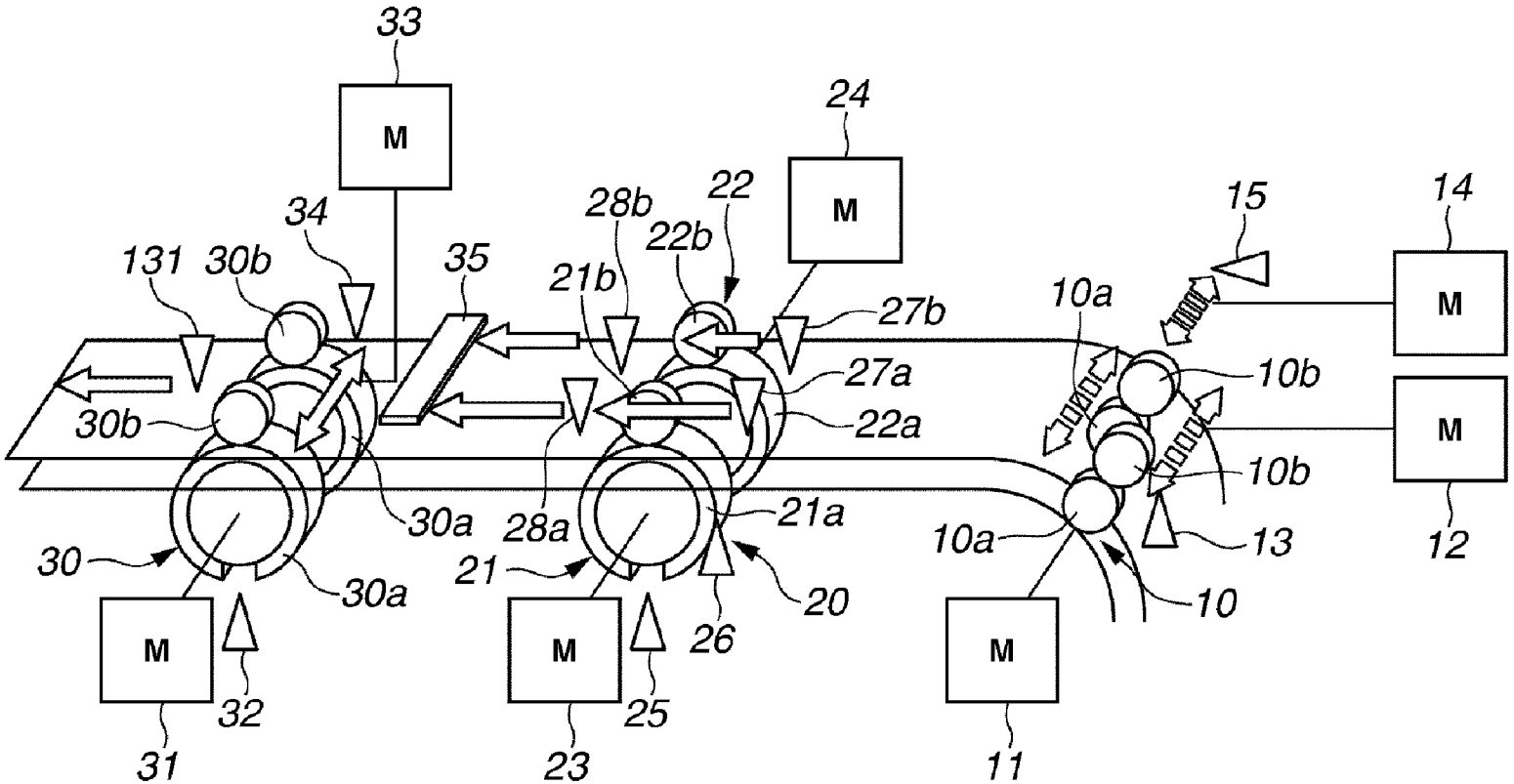
FIG. 2 is a schematic view of a registration device according to the first exemplary embodiment.
Figure 3:
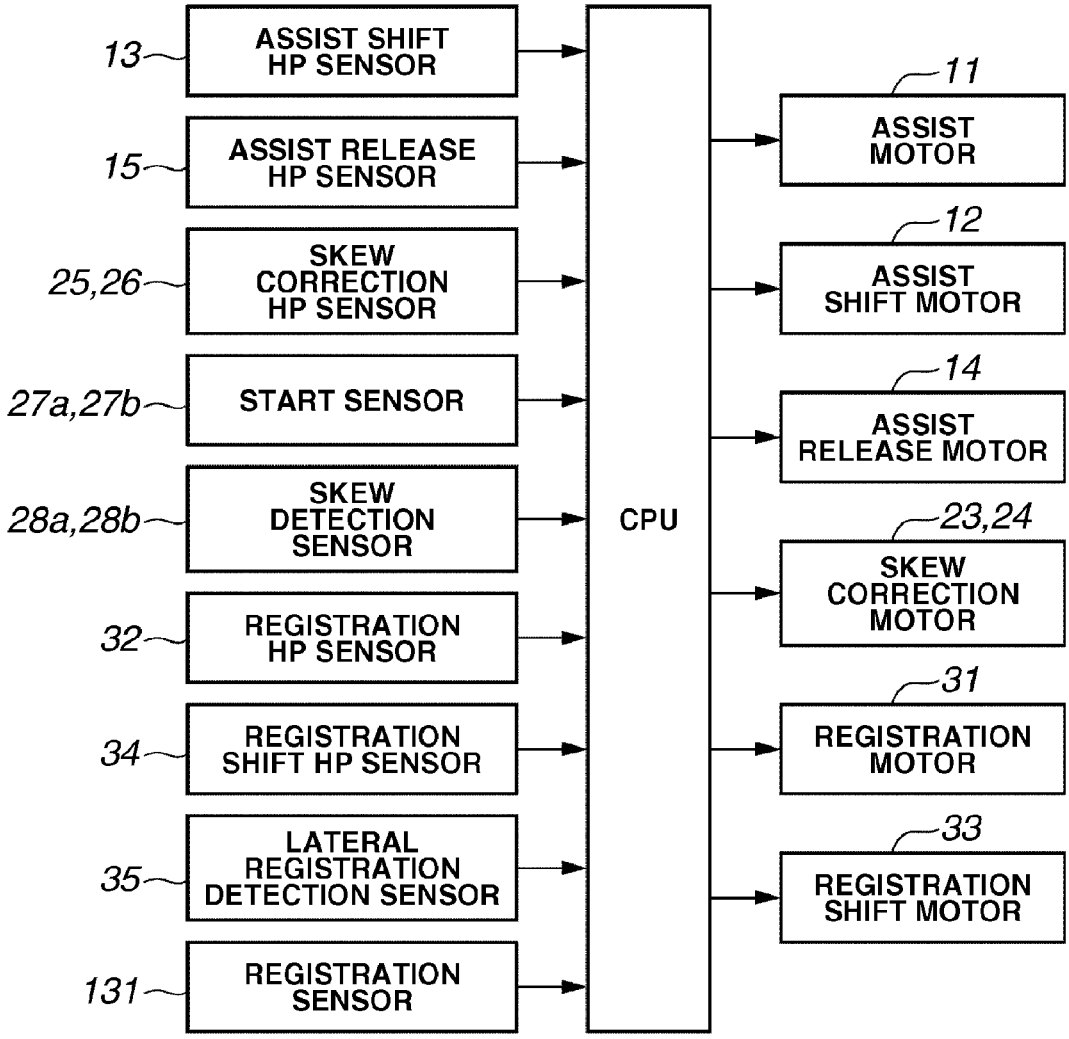
FIG. 3 is a block diagram of a controller according to the first exemplary embodiment.

Next, details of the registration unit 1 will be described with reference to FIGS. 2 to 10. FIG. 2 is a schematic view illustrating a registration device according to one exemplary embodiment of the invention, and FIG. 3 is a block diagram.

With reference to FIG. 2, the assist roller pairs 10, the skew correction roller pairs 20 and the lateral registration roller pairs 30 are rotatably supported on side plates by means of frames (not shown).

The assist roller pairs 10 which constitute the sheet conveyance assist unit, are placed in a curved portion of the bending conveyance guide unit formed upstream of the conveyance path 110. The assist roller pairs 10 include assist drive rollers 10*a*, and assist driven rollers 10*b* that are brought in pressure contact with the assist drive rollers 10*a* by use of pressure springs (not shown). Coupled to the assist drive rollers 10*a* is an assist motor 11 that performs rotational drive for conveying a sheet in the sheet conveyance direction. Coupled to the assist roller pairs 10 is an assist shift motor 12 that moves the assist roller pairs 10 on the conveyance surface of a sheet in a direction orthogonal to the sheet conveyance direction (hereinafter referred to as a "sheet width direction"). An assist shift home position (HP) sensor 13 is arranged in the registration unit which detects the position of the assist roller pairs 10. Coupled to the assist driven rollers 10*b* is an assist release motor 14 that releases the assist driven rollers 10*b* from pressure contact (nip) with the assist drive rollers 10*a*. Also arranged in the registration unit is an assist release HP sensor 15 that detects the phase of the assist release motor 14 to determine the presence of the assist driven rollers 10*b* at the home positions. The assist release HP sensor 15 detects that the assist driven rollers 10*b* is released from the nip with the assist drive rollers 10*a*.

The skew correction roller pair 20 constituting the skew correction unit includes skew correction roller pairs 21 and 22, which are two sheet conveyance rolling pairs arranged at a predetermined interval $L_{RP}$ in the sheet width direction. The skew correction roller pairs 21 and 22 include C-shaped skew correction drive rollers 21*a* and 22*a* and skew correction driven rollers 21*b* and 22*b* that are brought in pressure contact with the skew correction drive rollers 21*a* and 22*b* by use of pressure springs (not shown), respectively. In order to independently drive the skew correction drive rollers 21*a* and 22*a*, skew correction motors 23 and 24 are coupled to the skew correction drive rollers 21*a* and 22*a*, respectively. The skew correction motors 23 and 24 drive the skew correction drive rollers 21*a* and 22*a* so that the skew correction drive rollers 21*a* and 22*a* convey the sheet S at different conveyance speeds which causes the sheet S to rotate. Thus, the skew of the sheet S is corrected.

Figure 9:
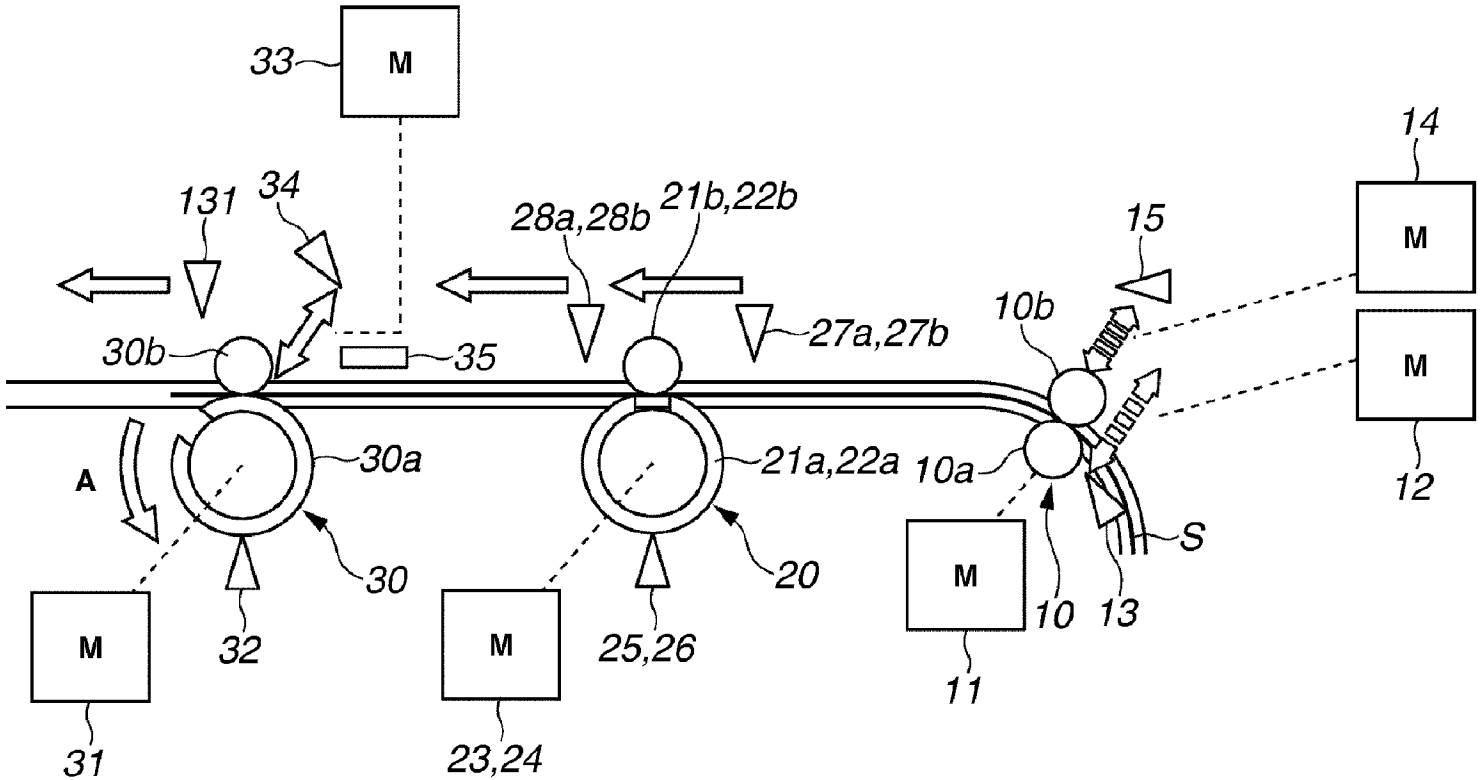
FIG. 9 is a view illustrating correction of lateral registration and leading edge registration in a cross-sectional direction according to the first exemplary embodiment.

Skew correction HP sensors 25 and 26 that detect the phases in the rolling direction of the skew correction drive rollers 21*a* and 22*a* to determine whether the skew correction drive rollers 21*a* and 22*a* are placed at the home positions. At the home positions of the skew correction drive rollers 21*a* and 22*a*, the cut portions of circumferential surfaces of the skew correction drive rollers 21*a* and 22*a* face the skew correction driven rollers 21*b* and 22*b*, respectively, as shown in FIG. 9. At the home positions, the skew correction driven rollers 21*b* and 22*b* are released from the nip with the skew correction drive rollers 21*a* and 22*a*, so that gaps that do not regulate a sheet are formed between the skew correction drive rollers 21*a* and 22*a* and the skew correction driven rollers 21*b* and 22*b*.

Start sensors 27*a* and 27*b* for starting the drive motors 23 and 24 are arranged upstream in the sheet conveyance direction from the registration roller pair 20 at a predetermined interval $L_{RP}$, in a direction orthogonal to the sheet conveyance. In synchronization with detection of the leading edge of the sheet S, the drive motors 23 and 24 are started.

Figure 6:
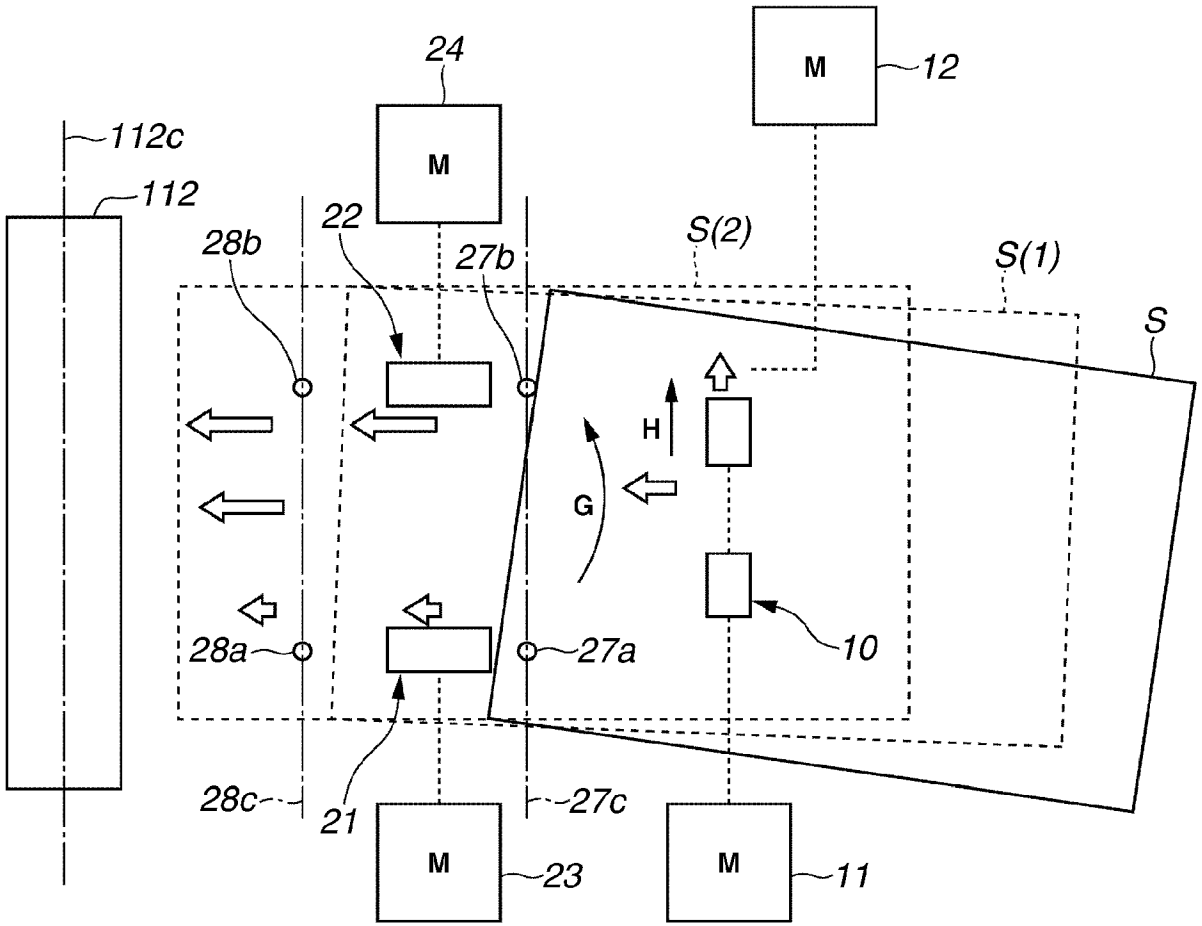
FIG. 6 is a view illustrating skew correction in a top face direction according to the first exemplary embodiment.

Further, skew detection sensors 28*a* and 28*b* for detecting the skew of the sheet S are arranged downstream in the sheet conveyance direction from the registration roller pair 20, at a predetermined interval $L_{RP}$ in the sheet width direction. Note that center lines 27*c* and 28*c* (see FIG. 6) connecting the start sensors 27*a* and 27*b* to the skew detection sensors 28*a* and 28*b* are arranged in parallel to an axis line 112*c* of the photosensitive drum 112 which is arranged downstream in the sheet conveyance direction, as shown in FIG. 6.

Figure 5:
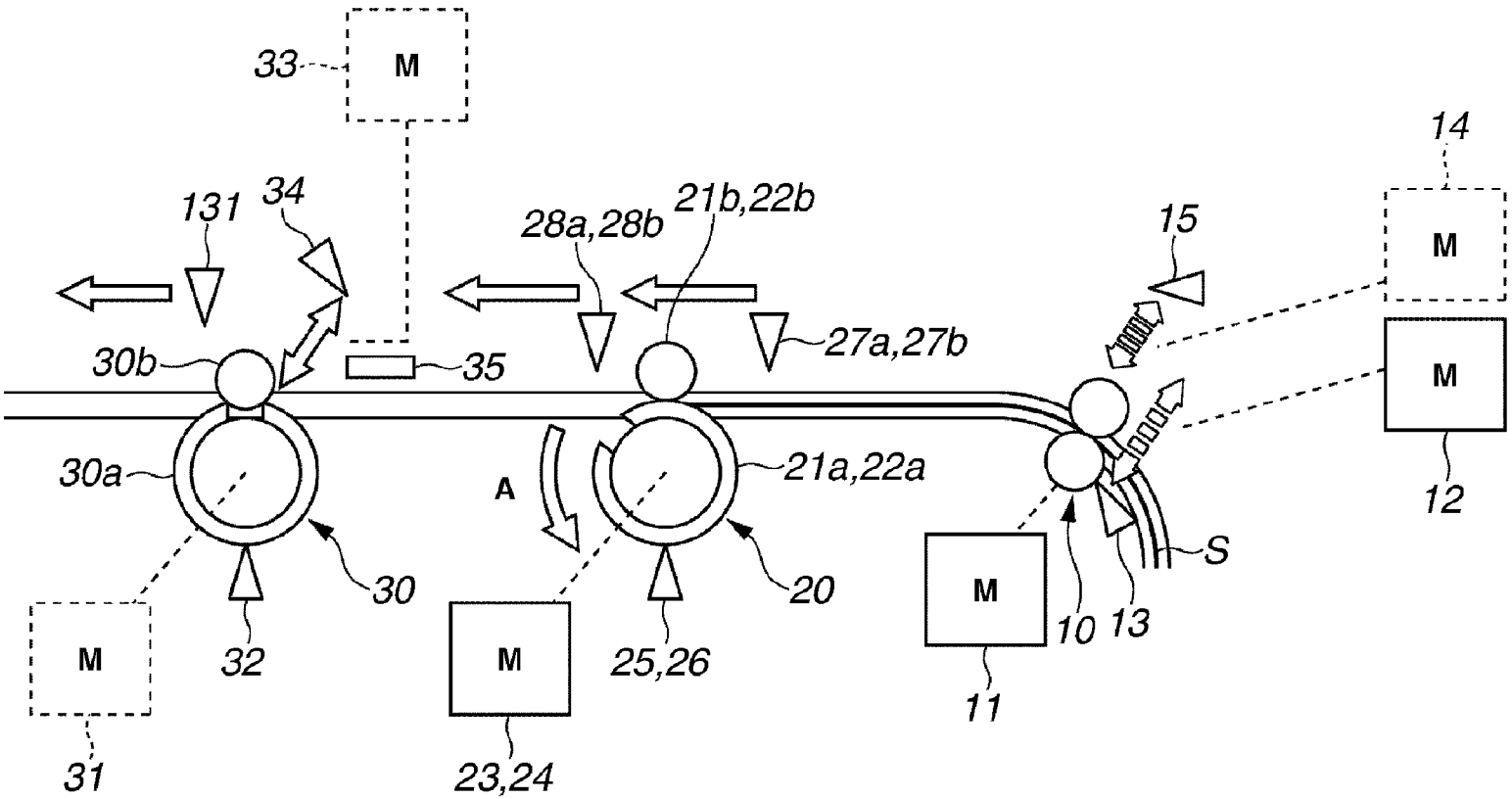
FIG. 5 is a view illustrating skew correction in a cross-sectional direction according to the first exemplary embodiment.

Two lateral registration roller pairs 30 constituting the lateral registration correction unit are placed in the sheet width direction, each including a C-shaped registration drive roller 30*a* and a registration driven roller 30*b* that is brought in pressure contact by means of a pressure spring (not shown) When a cut portion of the circumferential surface of the registration drive roller 30*a* faces the registration driven roller 30*b* as shown in FIG. 5, the registration driven roller 30*b* is released from the nip with the registration drive roller 30*a*. As a result, a gap that does not regulate a sheet is formed between the registration drive roller 30*a* and the registration driven roller 30*b*.

Coupled to the registration drive rollers 30*a* is a registration motor 31 for driving the rollers 30*a* in the sheet conveyance direction. A registration HP sensor 32 that detects the phase of the lateral registration roller pairs 30 is also arranged. Coupled to the lateral registration roller pairs 30 is a registration shift motor 33 for moving the lateral registration roller pairs 30 in the sheet width direction. Further, a registration shift HP sensor 34 is arranged which detects whether the positions of the lateral registration roller pairs 30 in the sheet width direction, coincide with the home positions. It is to be noted that the sheet s in this embodiment is conveyed using the center reference. Therefore, the lateral registration roller pairs 30 shift the sheet s so that the center in the width direction of the sheet S to be corrected, is the position of the center reference.

Upstream in the sheet conveyance direction from the lateral registration roller pairs 30, a lateral registration detection sensor 35 is arranged which detects the lateral registration position of the sheet S in a direction orthogonal to the sheet conveyance direction. Downstream from the lateral registration roller pairs 30, a registration sensor 131 for detecting the leading edge of the conveyed sheet S is arranged.

FIG. 3 is a block diagram of the controller 120; detection information from sensors is input into a CPU. The CPU appropriately transmits a drive signal to each motor so that control which is described later, is performed.

Figure 4:
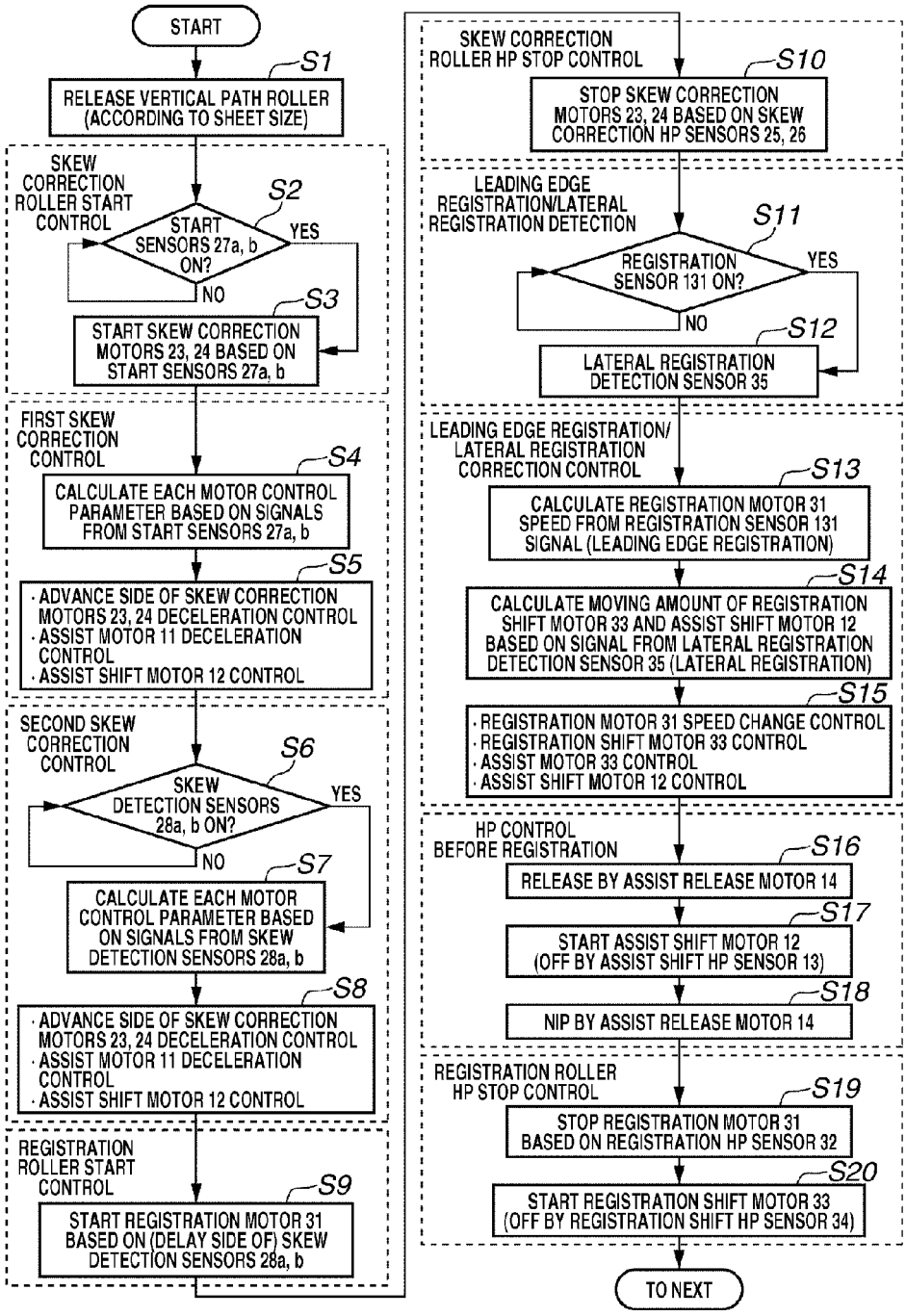
FIG. 4 is a flowchart of control according to the first exemplary embodiment.
Figure 10:
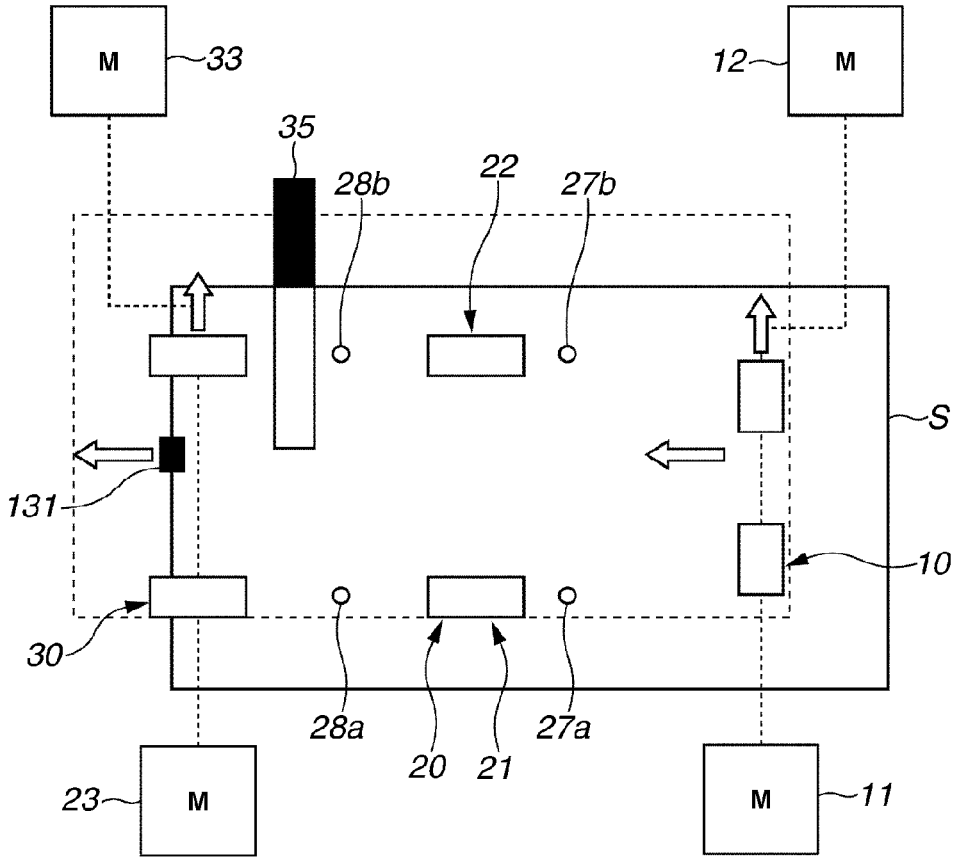
FIG. 10 is a view illustrating correction of lateral registration and leading edge registration in a top face direction according to the first exemplary embodiment.
Figure 11:
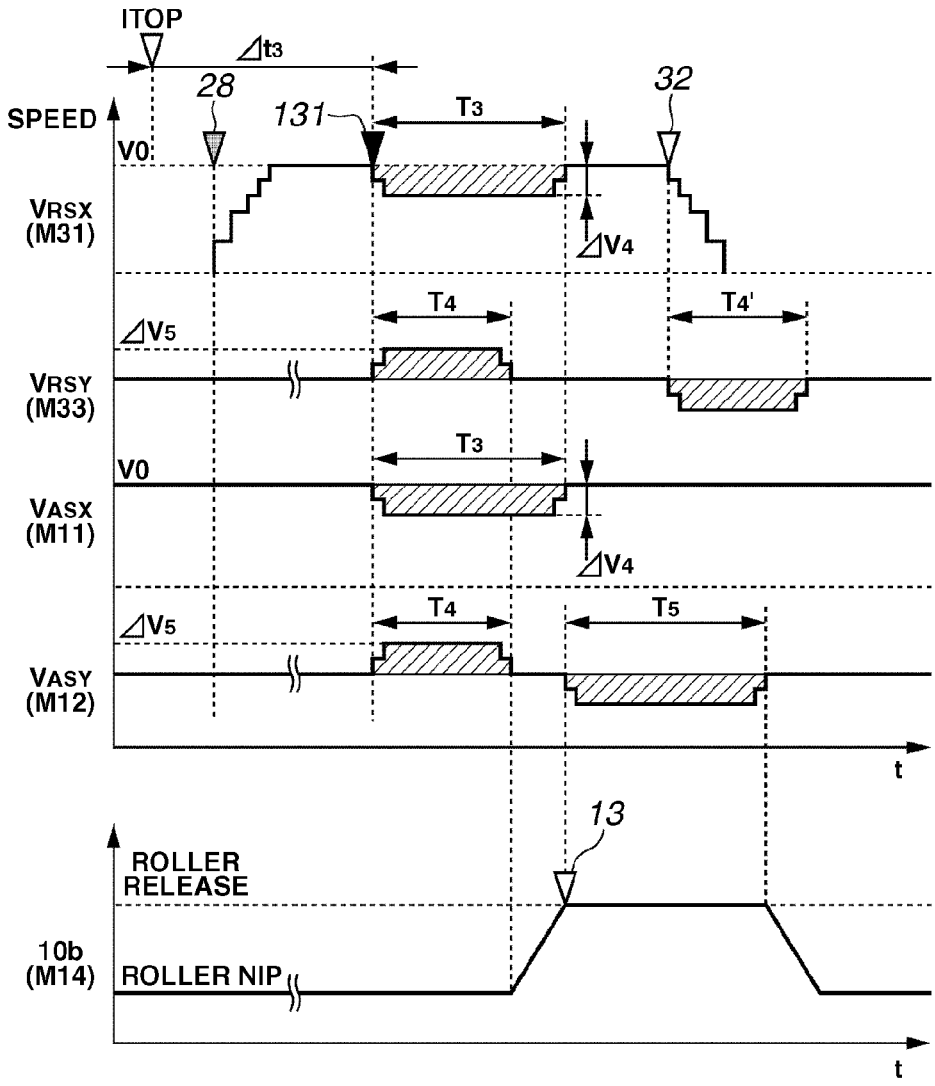
FIG. 11 is a view illustrating motor operations in correction of lateral registration and leading edge registration according to the first exemplary embodiment.

Next, correction operations in the registration unit 1 will be described with reference to FIGS. 4 to 11. FIG. 4 is a flowchart illustrating the operation outline, FIGS. 5 to 8 are schematic views illustrating skew correction, and FIGS. 9 to 11 are schematic views illustrating leading edge registration and lateral registration correction. First, the operation outline will be described along the flowchart in FIG. 4.

A sheet S fed from the cassettes 100 and 100' is conveyed to the assist roller pairs 10 by the conveyance roller pair 105*a* and 105*b*. In the assist roller pairs 10, the driven rollers 10*b* are released from the pressure contact with the assist drive rollers 10*a* by a roller release motor (not shown) as the need arises depending on the sheet size (step S1). When the start sensors 27*a* and 27*b* detect the leading edge of the sheet S conveyed by the assist roller pairs 10 (step S2), skew correction motors 23 and 24 are started based on respective sensors (step S3). The skew correction drive rollers 21*a* and 22*a* of the skew correction roller pairs 21 and 22 which were released from the nip with the rollers, are rotated (in the A direction in FIG. 5) to convey the sheet S.

Figure 8:
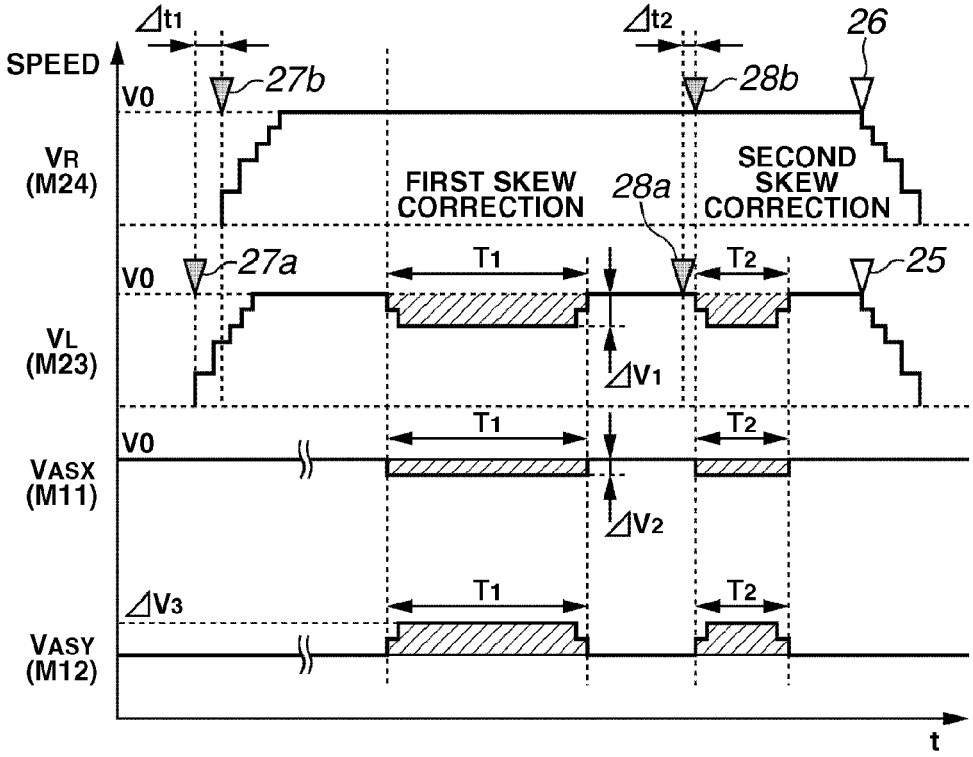
FIG. 8 is a view illustrating motor operation in skew correction according to the first exemplary embodiment.

As shown in the operation illustrating diagram in FIG. 8, the skew amount of the leading edge of the sheet S is calculated from a detection time difference $\Delta t_1$ of the start sensors 27*a* and 27*b*. If the start sensor 27*a* detects the sheet S first, the sheet conveyance speed of the skew correction roller pair 21 (skew correction motor 23) is decelerated, and control parameters for skew correction (i.e., a skew time $T_1$ and a decelerated speed $\Delta V_1$) are calculated so that a following equation is satisfied.

$$V_0 \times \Delta t_1 = \int_{T_1} \Delta V_1 dt \qquad \text{formula (1)}$$

Figure 7:
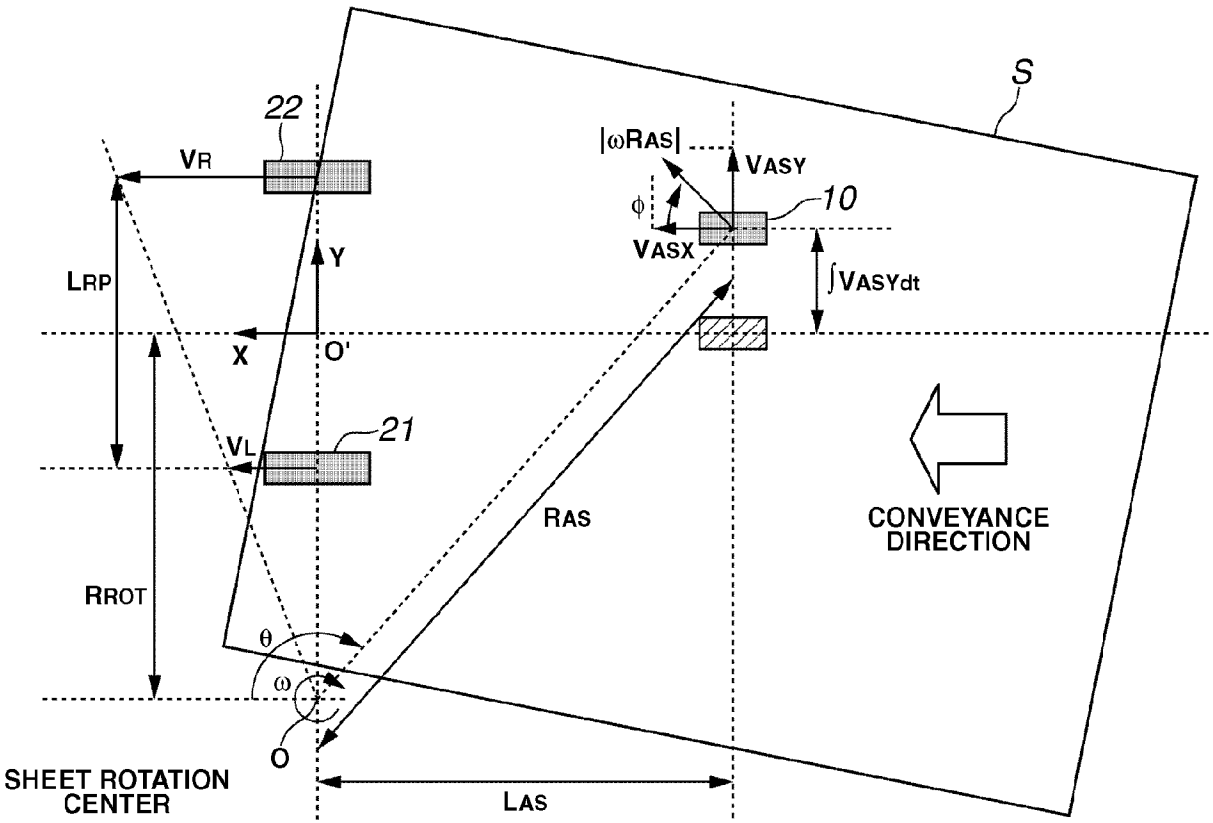
FIG. 7 is a view illustrating operation parameters in skew correction in the top face direction according to the first exemplary embodiment.

The sheet conveyance speed of assist rollers is determined from the relationship shown in FIG. 7. Supposing that the sheet conveyance speed of the correction roller pairs 21 and 22 during correction are $V_L$ and $V_R$, the thrust pitch between the correction rollers is $L_{RP}$, and the rotation speed at the rotation center of the sheet S is ω, $$\omega = \frac{V_R - V_L}{L_{RP}} \qquad \text{formula (2)}$$

Supposing that the rotating distance from the rotation center O of the sheet S to the middle point O' of the correction roller pairs 21 and 22 is $R_{ROT}$, a following equation is obtained from "$R_{ROT} \cdot \omega \equiv (V_L + V_r)/2$":

$$R_{ROT} = \frac{V_L + V_R}{2|V_R - V_L|} \cdot L_{RP} \qquad \text{formula (3)}$$

Supposing that a conveyance direction speed of the assist roller pairs 10 is $V_{ASX}$, a thrust direction speed $V_{ASY}$, the distance between the correction roller pair 21 and 22 and the assist roller pairs 10 is $L_{AS}$, the rotating distance from the rotation center O of the sheet S to the assist roller pairs 10 is $R_{AS}$, $$R_{AS} = \sqrt{L_{AS}^2 + (R_{ROT} + \int V_{ASY} dt)^2} \qquad \text{formula (4)}$$

Supposing that the angle between the sheet conveyance direction and the line connecting the rotation center O of the sheet S to the assist roller pairs 10 is θ, and the angle between the sheet conveyance direction and the line connecting the rotation center O of the sheet S to the composed conveyance speed $|\omega R_{AS}|$ of the sheet S by the assist roller pairs 10 is ϕ, $\phi = \theta - \pi/2$ From the above, the conveyance direction speed $V_{ASX}$ and the thrust direction speed $V_{ASY}$ of the assist roller pairs 10 are expressed as the following relational expressions.

$$V_{ASX} = |\omega R_{AS}| \cdot \cos\phi = \left|\omega \cdot \left(R_{ROT} + \int V_{ASY} dt\right)\right| = \frac{V_L + V_R}{2} + \frac{|V_L - V_R| \cdot \int V_{ASY} dt}{L_{RP}} \qquad \text{formula (5)}$$

$$V_{ASY} = -\omega R_{AS} \cdot \sin\phi = -\omega L_{AS} = \frac{L_{AS}}{L_{RP}}(V_L - V_R) \qquad \text{formula (6)}$$

If the skew amount is sufficiently small, an approximation of $$\int V_{ASY} dt \cong 0$$

can be made. Therefore, $$V_{ASX} \cong \frac{V_L + V_R}{2}, \quad V_{ASY} \cong \frac{L_{AS}}{L_{RP}}(V_L - V_R) \qquad \text{formula (7)}$$

Consequently, $$\Delta V_2 \cong \Delta V_1 / 2, \quad \Delta V_3 \cong \Delta V_1 \times L_{AS} / L_{RP}$$

As described above, various control parameters for performing skew correction are calculated (step S4), and the skew correction motors 23 and 24, the assist motor 11 and the assist shift motor 12 are controlled as shown in FIG. 8 to perform the first skew correction ($T_1$) (step S5). Thus, the skew correction roller pairs 21 and 22 are independently driven and their sheet conveyance speeds are differentiated based on the skew amount of the sheet S. As a result, the sheet S is rotated which allows correction of the skew. At the same time, the assist roller pairs 10 are moved in the axial direction to follow the rotating sheet S which prevents twist of the rotating sheet S. Namely, as indicated in FIG. 6, the sheet S rotates in the G direction during skew correction by the correction roller pairs 21 and 22, and the assist roller pairs 10 are moved in the sheet width direction H along the rotating direction to assist the rotating of the sheet S. Thus, the precision of skew correction can be enhanced.

At this point, the roller phases of the skew correction drive rollers 21*a* and 22*a* become the same and the skew correction of the sheet S is performed. However, if the sheet thickness or size of the sheet S is large, or if the rear edge of the sheet S is in the bending path, the skew cannot be completely corrected as indicated by S (1) in FIG. 6. In this case, the skew amount of the sheet S is detected by the skew detection sensors 28*a* and 28*b* positioned downstream (step 6), and various control parameters for skew correction are calculated similar to the first skew correction (step S7), and then the second skew correction ($T_2$) is performed (step S8). As a result, the skew of the sheet S is completely corrected such that the sheet S is in the state indicated by S(2) in FIG. 6.

After the skew has been corrected by the skew correction roller pairs 21 and 22, the sheet S is conveyed to the lateral registration roller pairs 30. For the lateral registration roller pairs 30, the registration motor 31 is started based on the delay side of the skew detection sensors 28*a* and 28*b* (step S9). Then, the lateral registration roller pairs 30 which were released from the nip, is rotated (in the A direction in FIG. 9), so that the sheet S is conveyed. When the sheet S is held between the rollers of the lateral registration roller pairs 30 after the skew correction, the skew correction motors 23 and 24 are stopped based on signals of the skew correction HP sensors 25 and 26, respectively, with roller nip portions of the skew correction roller pairs 21 and 22 released as shown in FIG. 9 (step S10).

When the leading edge of the sheet S is detected by the registration sensor 131 (step S11), the position of the lateral edge of the sheet S is detected at the same time by the lateral registration detection sensor 35 (step S12). The time difference $\Delta t_3$ between the detection timing of the registration sensor 131 and the radiating timing of laser light onto the photosensitive drum 112 (ITOP) is detected. Based on the difference, the leading edge of an image conveyed over the distance $l_0$ from a laser radiation position 112*a* to the transfer portion 112*b* of the photosensitive drum 112 can coincide with the leading edge of the sheet S conveyed over the distance $l_1$ from the registration sensor 131 to the transfer portion 112*b*. For this purpose, the decelerated speeds $\Delta V_4$ and the speed change time $T_3$ of the registration motor 31 and the assist motor 11 are calculated (step S13).

Further, based on a detection signal of the lateral registration detection sensor 35, the speeds in the shift direction $\Delta V_5$ and the speed change time $T_4$ of the registration shift motor 33 and the assist shift motor 12 are calculated so that the lateral registration position of an image on the photosensitive drum 112 coincides with that of the sheet S (step S14).

Then, the registration motor 31, the registration shift motor 33, the assist motor 11 and the assist shift motor 12 are controlled so that the lateral registration roller pairs 30 and the assist roller pairs 10 rotate and move in the axial direction (sheet width direction). In this case, since the speeds in the shift direction $\Delta V_5$ and the speed change time $T_4$ of the registration shift motor 33 and the assist shift motor 12 are equal, the distance that the lateral registration roller pairs 30 and the assist roller pairs 10 move in the axial direction, are equal.

Thus, the image position on the photosensitive drum 112 can coincide with the leading edge and the lateral registration position of the sheets (step S15). When the lateral registration roller pair 30 and the assist roller pairs 10 are moved in the axial direction after skew correction is carried out, the cut portions of circumferential surfaces of the skew correction drive rollers 21*a* and 22*a* of the skew correction roller pairs 21 and 22 face the skew correction driven rollers 21*b* and 22*b*, respectively. As a result, the sheet S is positioned at gaps between the skew correction drive rollers 21*a* and 22*a* and the skew correction driven rollers 21*b* and 22*b*, and therefore the sheet S is not regulated.

As described above, when the lateral registration roller pairs 30 move (shift) in the axial direction based on signals of the registration sensor 131 to adjust the lateral registration position, the assist roller pairs 10 also move (shift) in the same direction as the lateral registration roller pairs 30 in synchronization with the movement of the roller pairs 30. Thus, the twist of the sheet S can be suppressed during lateral registration correction operations.

When the shift operations of the sheet S are completed, the driven rollers 10*b* of the assist roller pairs 10 are released from the nip by the assist release motor 14 (step S16). When the release of the assist roller pairs 10 from the nip is detected by the assist release HP sensor 15, the assist shift motor 12 is started, the assist roller pairs 10 shift in the reverse direction to the direction in step S15, and stops when detected by the assist shift HP sensor 13 (step S17). At this point, the assist roller pairs 10 have moved in the shift direction over a distance corresponding to the first and second skew correction and the lateral registration correction, and therefore the assist shift motor 12 shifts for time $T_5$ at the maximum drivable movement speed. The assist roller pairs 10 are nipped again by the assist release motor 14 at the position where the rear edge of the sheet S passes through the assist roller pairs 10 (step S18).

The sheet S conveyed by the lateral registration roller pairs 30 is adsorbed to the photosensitive drum 112 to transfer an image, and, based on the detection of the registration HP sensor 32, the registration motor 31 is stopped while the rollers of the lateral registration roller pairs 30 are released from the nip (step S19). At the same time, the registration shift motor 33 is started, and the registration roller pairs 30 shift in the reverse direction to the direction in step S15, and stops when detected by the registration shift HP sensor 34 (step S20). When the lateral registration roller pairs 30 is stopped, the cut portions of the circumferential surfaces of the registration drive rollers 30*a* face the registration driven rollers 30*b*. Accordingly, the rollers are released from the nip. Therefore, the sheet S is not forcibly conveyed, which prevents poor image quality such as image blur on the photosensitive drum 112.

By repeating the above-described steps S1 to 20, the skew correction of the sheet S and the position correction of the image on the drum 112 and the sheet S can be performed precisely and continuously.

Figure 12:
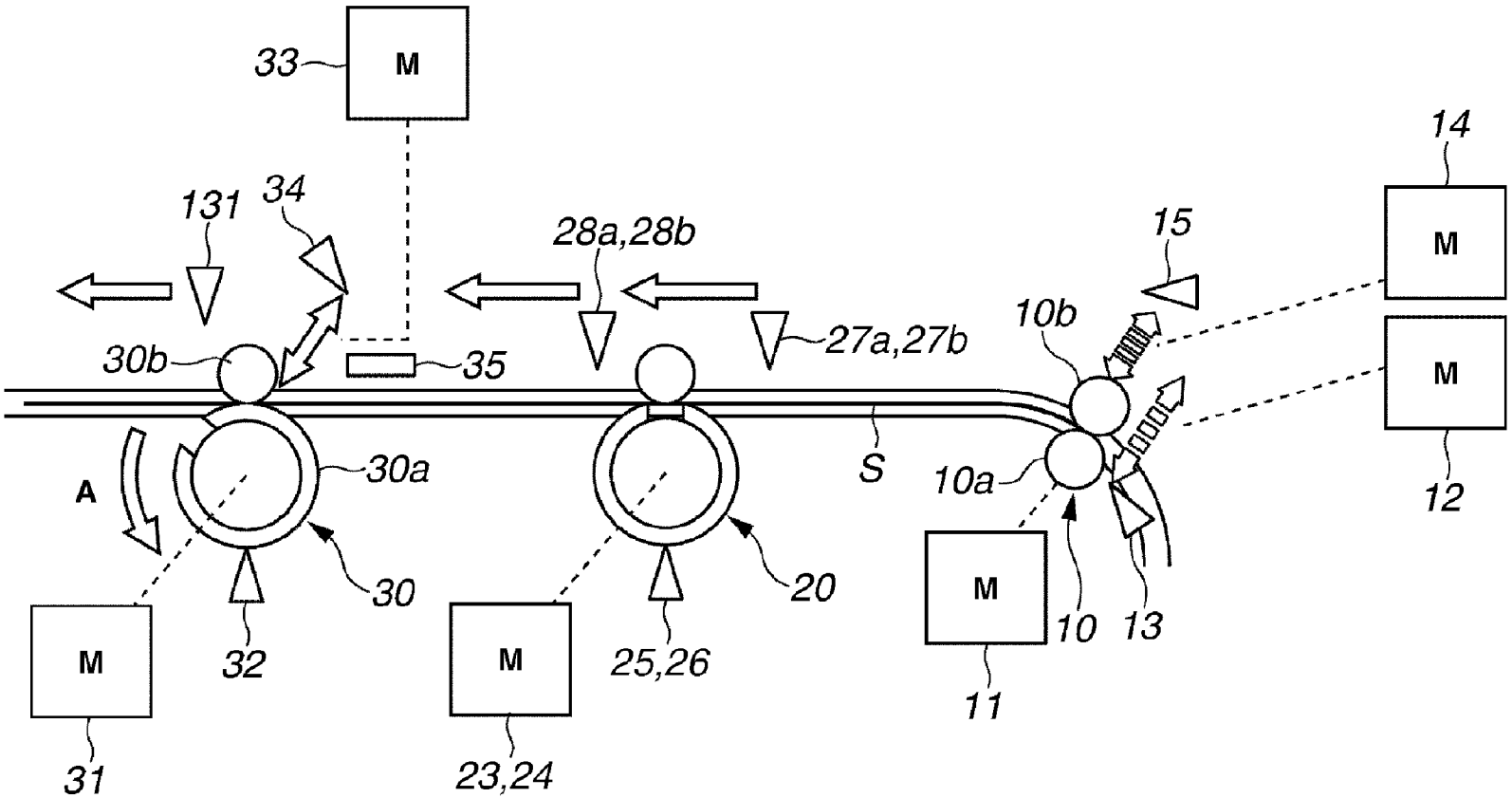
FIG. 12 is a view illustrating correction of lateral registration and leading edge registration in a cross-sectional direction according to the first exemplary embodiment.
Figure 13:
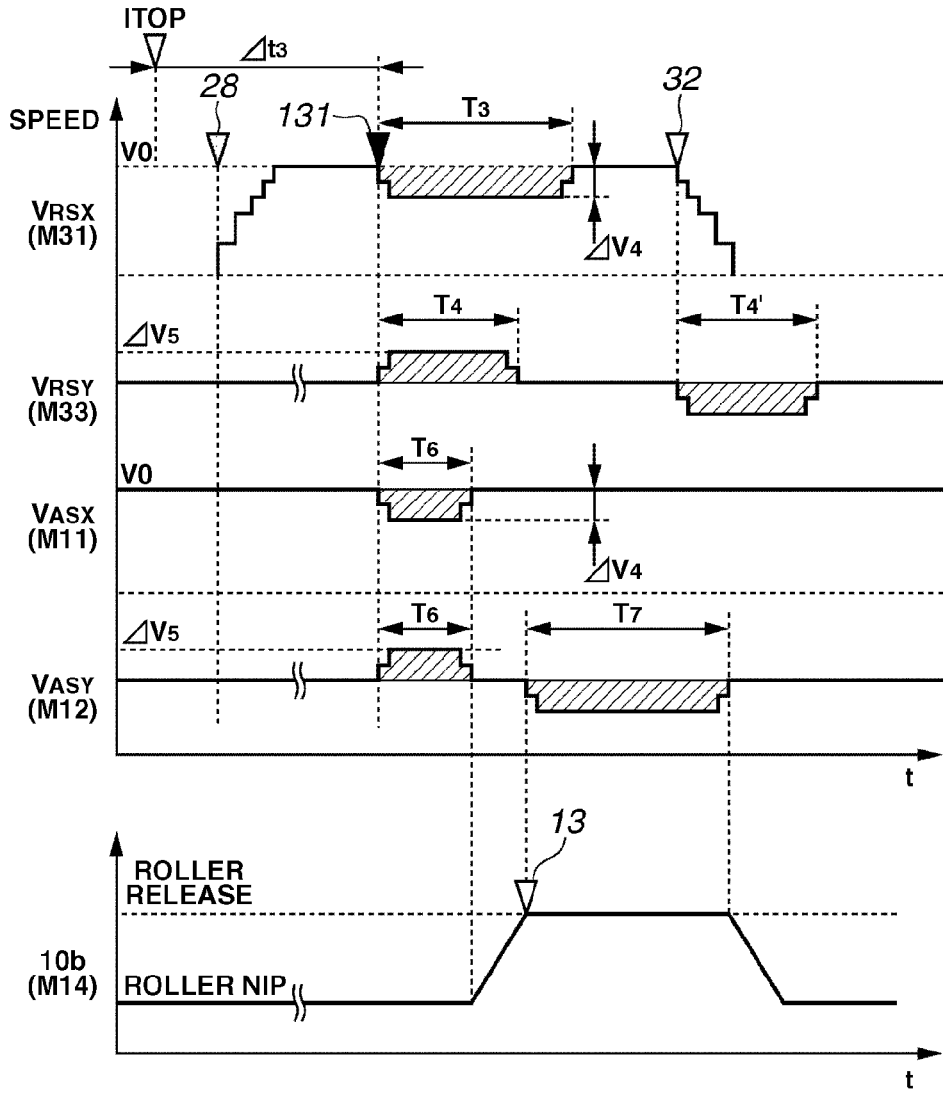
FIG. 13 is a view illustrating motor operations in correction of lateral registration and leading edge registration according to the first exemplary embodiment.

Next, a case is described in which the conveyed sheet S has a short length. FIG. 12 illustrates the state where the rear edge of the sheet S passes through the nip portions of the assist roller pairs 10 while the registration motor 31, the registration shift motor 33, the assist motor 11 and the assist shift motor 12 are performing control to correct the sheet S (step S15). FIG. 13 is a view illustrating operations of motors in this state.

As shown in FIG. 13, time $T_6$ in which the rear edge of the sheet S passes through the nip portion of the assist roller pairs 10 is predicted based on the detection signal of the registration sensor 131 and the sheet length of the sheet S. When the time $T_6$ has passed, the assist motor 11 and the assist shift motor 12 are immediately stopped. Then, the driven rollers 10*b* of the assist roller pairs 10 are released by the assist release motor 14 (step S16).

When the release of the assist roller pairs 10 is detected by the assist release HP sensor 15, the assist roller pairs 10 shift in the reverse direction to the direction in step S15 driven by the assist shift motor 12. Further, when the assist roller pairs 10 are detected by the assist shift HP sensor 13, the shift of the roller pairs is stopped (step S17). After time $T_7$ has passed, the assist roller pairs 10 are nipped again by the assist release motor 14 (step S18). In this way, the assist roller pairs 10 are returned to the initial state to prepare for the following sheet. Subsequently, by repeating the above-described operations, the skew correction of the sheet S and the position correction of the image and the sheet S can be performed precisely and continuously. Like this case, if the rear edge of the sheet S passes through the nip portions of the assist roller pairs 10 while the sheet s is controlled for the lateral registration, the assist rollers 10 are returned to the initial state immediately after the sheet S has passed through the assist roller pairs 10. Thus, the next sheet can be conveyed rapidly without delay, and sheets which are fed at short intervals can be sufficiently dealt with. That is, control of movement of the assist roller pairs 10 can be changed in the direction orthogonal to the sheet width direction according to the length of a sheet, as described above, so that appropriate control can be performed according to the sheet size.

Second Exemplary Embodiment

Figure 14:
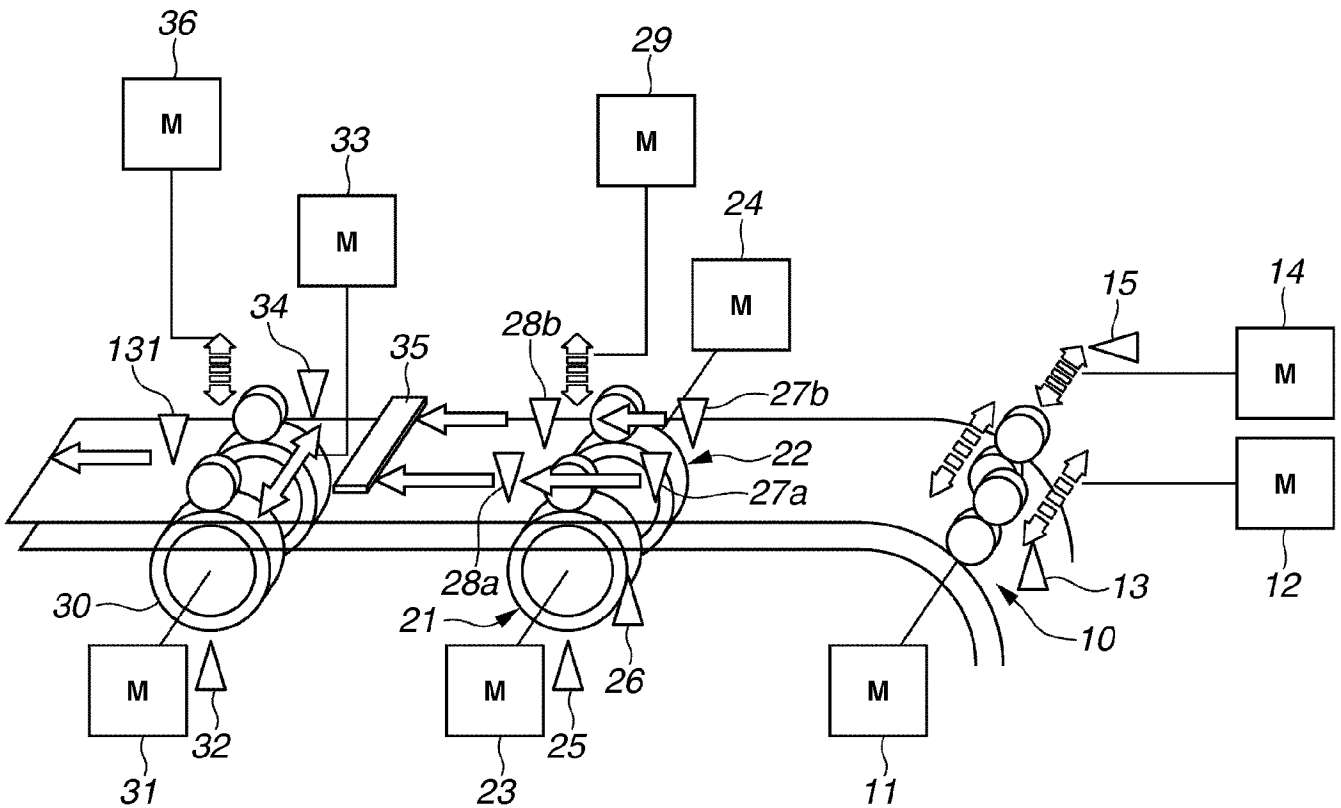
FIG. 14 is a view illustrating correction of lateral registration and leading edge registration according to a second exemplary embodiment.

In the second exemplary embodiment, cylindrical skew correction rollers 21' and 22', instead of the C-shaped skew correction roller pairs 21 and 22 of the first exemplary embodiment, and a skew correction release motor 29 for releasing a skew correction driven roller are provided as shown in FIG. 14. The motor 29 releases the skew correction rollers 21' and 22' from the pressure contact (nip) and switches the contact and release from the sheet S.

Similarly, cylindrical registration rollers 30', instead of the C-shaped lateral registration roller pairs 30 of the first exemplary embodiment, and a registration release motor 36 for releasing the registration driven roller are provided in the second exemplary embodiment. The motor 36 releases the registration rollers 30' from the pressure contact (nip) and switches contact and release of the rollers from the sheet S.

In the first exemplary embodiment, the contact and release of the rollers from the sheet S is controlled by stopping the skew correction motors 23 and 24 and the registration motor 31. In the second exemplary embodiment, the contact and release of the rollers from the sheet S is controlled by controlling the skew correction release motor 29 and the registration release motor 36. Thus, the same effects as those in the first exemplary embodiment can be obtained. Other elements are the same as those described in the first exemplary embodiment, and descriptions thereof will not be repeated.

Third Exemplary Embodiment

Figure 15:
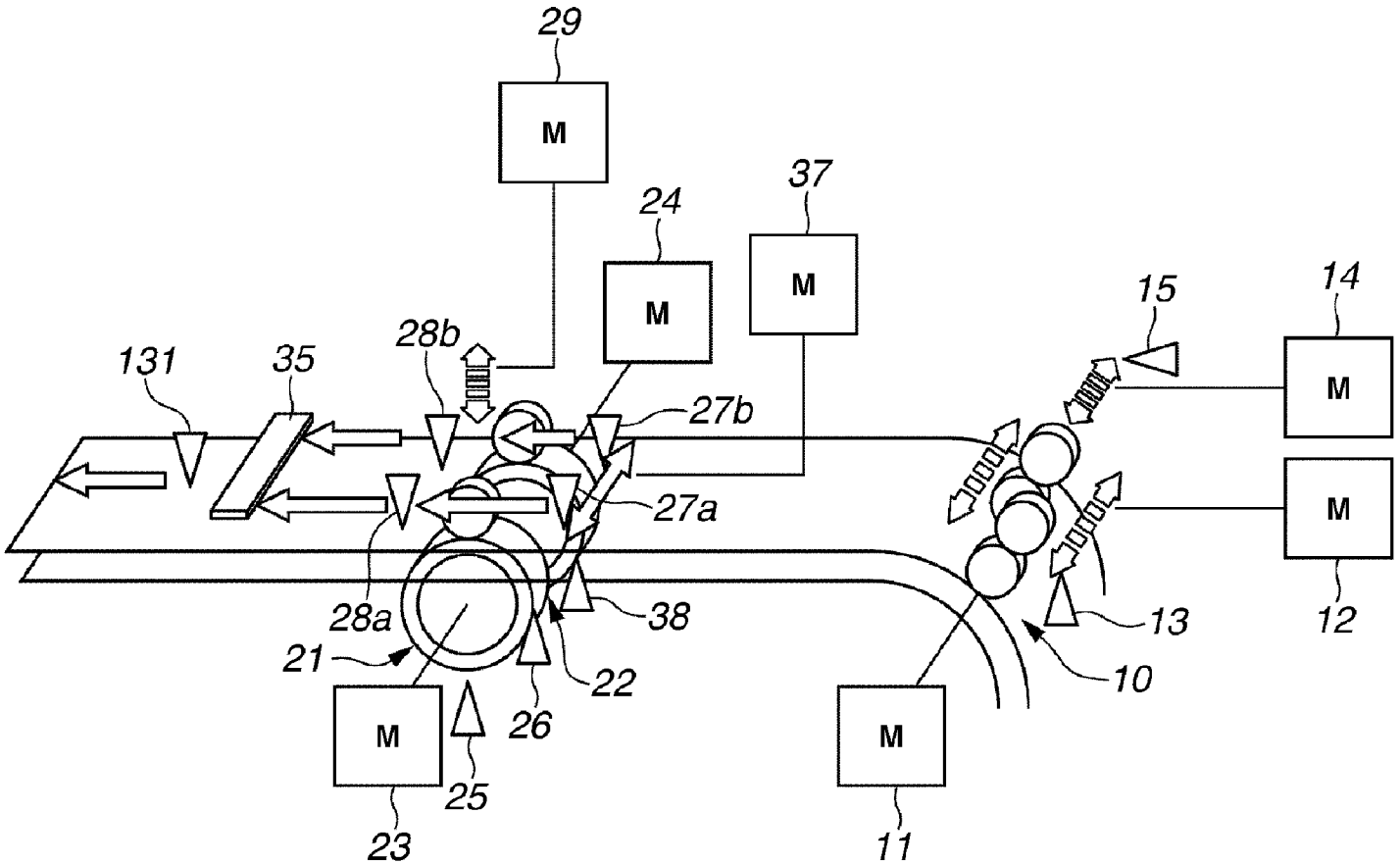
FIG. 15 is a view illustrating correction of lateral registration and leading edge registration according to a third exemplary embodiment.
Figure 16:
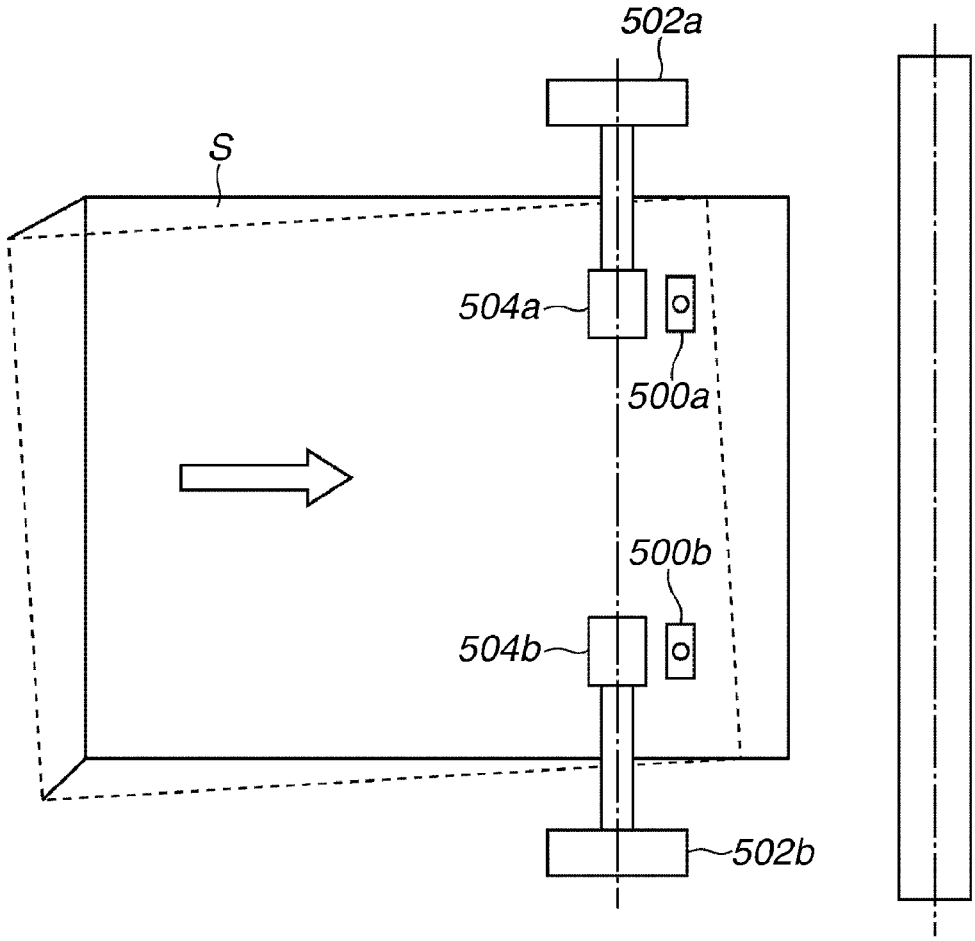
FIG.16 (PRIOR ART)
FIG. 16 is a view illustrating skew correction in a conventional conveyance apparatus.
Figure 17:
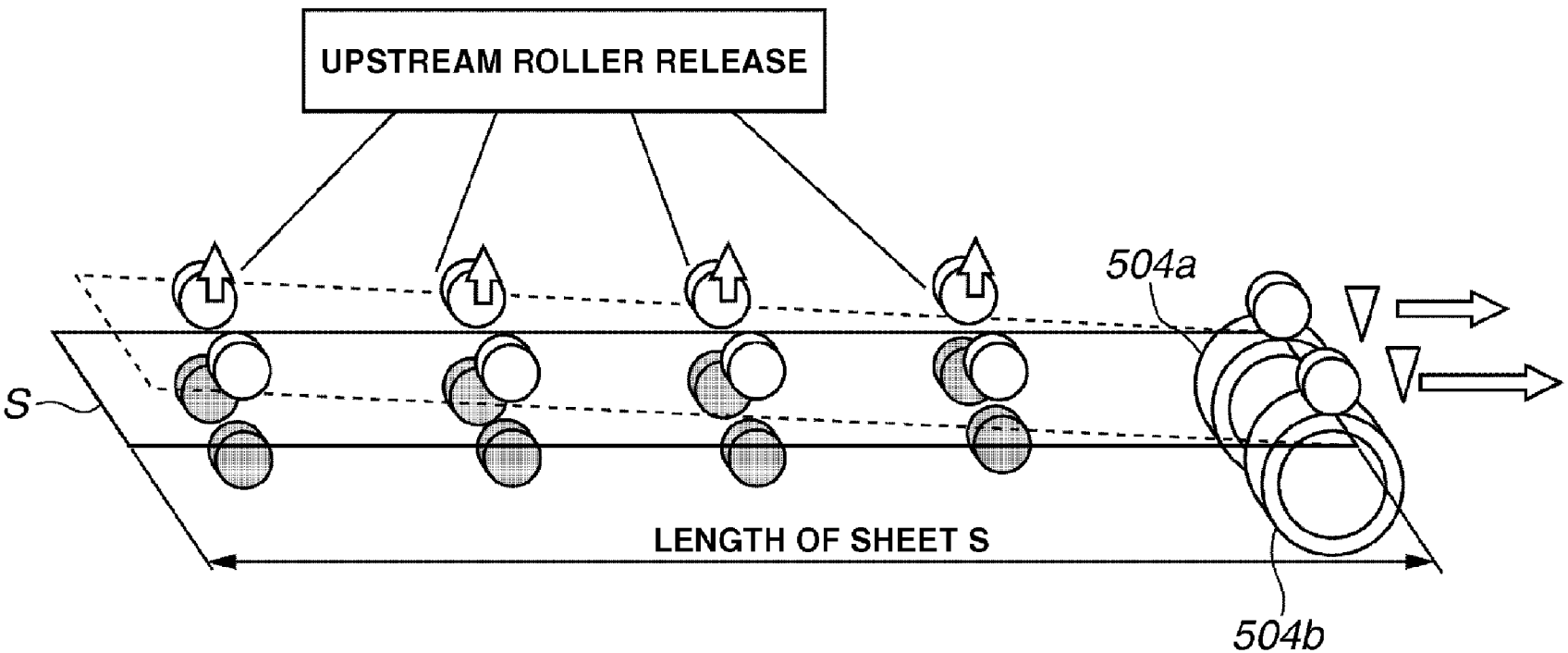
FIG.17 (PRIOR ART)
FIG. 17 is a view illustrating skew correction in a conventional conveyance apparatus.

In addition to the configurations of the first and second exemplary embodiments, the configuration shown in FIG. 15 has the similar effects. In the present embodiment, the lateral registration roller pairs 30', which are provided in the second exemplary embodiment, are not utilized. Instead, a skew correction shift motor 37 and a skew correction shift HP sensor 38 integrally shift a skew correction roller pairs 21' and 22' according to the second exemplary embodiment. In this configuration, after skew correction control has been performed using the skew correction roller pairs 21' and 22', control is performed using the skew correction roller pair 21' and 22' such that the leading edge position and the lateral registration position of an image on the photosensitive drum 112 coincide with an image of the sheet S. Thus, the same effects as those in the first and second exemplary embodiments can be obtained. Other elements are the same as those described in the first and second exemplary embodiments, and descriptions thereof will not be repeated.

As described above, if a bending conveyance guide is arranged upstream from the registration unit 1, and the skew correction and the lateral registration movement are performed on the large, thick sheet S, which has large inertia force and large bending rigidity, the skew correction can be reliably carried out. That is, the skew correction and the lateral registration correction are simultaneously performed using the skew correction roller pairs 21 and 22 (21' and 22'), the lateral registration roller pairs 30 (30'), and the assist roller pairs 10 in the bending conveyance guide. As a result, a large conveyance resistance to the sheet S can be overcome. This prevents slippage of the sheet that can occur when the sheet S is conveyed, which can dramatically improve precision of skew correction and lateral registration correction of the sheet S.

The above-described features provide a sheet conveyance apparatus that can precisely correct various skew angles and displacement with a low-cost configuration, as well as miniaturize devices.

The present invention is not limited to the above-described embodiments. In the above exemplary embodiments, the speeds of two skew correction rollers which serve as the skew correction unit are independently controlled to rotate a sheet so as to correct the skew. However, the invention can also be applied, for example, to a configuration where a pair of rollers is rotatably provided, the skew amount of a skewed sheet is detected by a sensor, and the pair of rollers is rotated to rotate the sheet while holding the sheet therebetween based on the skew amount for the sheet. The skew is thereby corrected.

According to the described embodiments, the invention is applied to, as an example, the registration unit 1 of the printing apparatus 1000, which is an image forming apparatus to form an image on a sheet; however, the invention is not limited to the embodiments, but can also be applied to an image reading apparatus that reads images from an original document. That is, the invention can be applied to a registration unit of the automatic document feeder 250 mounted on the printing apparatus 1000 that feeds an original document to be read by the scanner 2000 in which the registration unit corrects the skew of an original document.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-172660 filed Jun. 22, 2006, which is hereby incorporated by reference herein in its entirety.

What is claimed is:

1. A sheet conveyance apparatus comprising:

a skew correction unit configured to rotate a sheet while conveying the sheet to correct skew of the sheet, and the skew correction unit includes two sheet conveyance rolling pairs independently arranged in the direction orthogonal to the sheet conveyance direction, the skew of the sheet is corrected according to a difference in a sheet conveyance speed between the sheet conveyance rolling pairs;

a lateral registration correction unit which is arranged downstream from the skew correction unit, the lateral registration correction unit configured to move the conveyed sheet in the direction orthogonal to the sheet conveyance direction to correct a sheet position; and a sheet conveyance assist unit which is arranged upstream from the skew correction unit, the sheet conveyance assist unit configured to move the conveyed sheet in the direction orthogonal to the sheet conveyance direction, wherein after skew correction of the sheet is performed by the skew correction unit, the sheet conveyance rolling pairs are released from nip, the lateral registration correction unit moves the sheet in the direction orthogonal to the sheet conveyance direction, and the sheet conveyance assist unit moves the sheet in the direction orthogonal to the sheet conveyance direction in synchronization with movement operation of the sheet by the lateral registration correction unit.

2. The sheet conveyance apparatus according to claim 1, wherein an amount of movement of the lateral registration correction unit in the direction orthogonal to the sheet conveyance direction which corrects the sheet position, is equal to an amount of synchronized movement of the sheet conveyance assist unit.

3. The sheet conveyance apparatus according to claim 1, wherein the sheet conveyance assist unit moves in the direction orthogonal to the sheet conveyance direction so as to follow the rotated sheet when the skew correction unit rotates the sheet to correct the skew of the sheet.

4. The sheet conveyance apparatus according to claim 1, wherein the sheet conveyance rolling pairs include a drive roller having a cut portion, and a driven roller which can be brought into the nip with the drive roller, and the sheet conveyance rolling pairs are released from the nip while the cut portion of the drive roller faces the driven roller.

5. The sheet conveyance apparatus according to claim 1, wherein a bending conveyance guide unit is arranged upstream in a conveyance direction from the skew correction unit, and the sheet conveyance assist unit is arranged in the bending conveyance guide unit.

6. The sheet conveyance apparatus according to claim 1, wherein movement of the sheet conveyance assist unit in a direction of the lateral registration correction unit is stopped and the sheet conveyance assist unit is returned to an initial state when a rear edge of the sheet passes through the sheet conveyance assist unit during a correction operation of lateral displacement of the sheet performed by the lateral registration correction unit.

7. The sheet conveyance apparatus according to claim 1, wherein the sheet conveyance assist unit moves in the direction orthogonal to the sheet conveyance direction so as to move along a rotating direction of the sheet when the skew correction unit rotates the sheet to correct the skew of the sheet.

8. An image forming apparatus comprising:

a sheet conveyance apparatus including, a skew correction unit configured to rotate a sheet while conveying the sheet to correct skew of the sheet, and the skew correction unit includes two sheet conveyance rolling pairs independently arranged in the direction orthogonal to the sheet conveyance direction, the skew of the sheet is corrected according to a difference in a sheet conveyance speed between the sheet conveyance rolling pairs;

a lateral registration correction unit which is movable and arranged downstream from the skew correction unit in a direction orthogonal to a sheet conveyance direction, the lateral registration correction unit configured to move in the direction orthogonal to the sheet conveyance direction while holding the conveyed sheet to correct a sheet position; and a sheet conveyance assist unit which is arranged upstream from the skew correction unit, the sheet conveyance assist unit configured to move in the direction orthogonal to the sheet conveyance direction while holding the conveyed sheet, wherein after skew correction of the sheet is performed by the skew correction unit, the sheet conveyance rolling pairs are released from nip, the lateral registration correction unit moves in the direction orthogonal to the sheet conveyance direction while holding the sheet, and the sheet conveyance assist unit moves in a direction of the lateral registration correction unit in synchronization with movement of the lateral registration correction unit while holding the sheet; and an image forming unit configured to form an image on a sheet conveyed by the sheet conveyance apparatus.

9. The apparatus according to claim 8, wherein an amount of movement of the lateral registration correction unit in the direction orthogonal to the sheet conveyance direction which corrects the sheet position, is equal to an amount of synchronized movement of the sheet conveyance assist unit.

10. The sheet conveyance apparatus according to claim 8, wherein the sheet conveyance assist unit moves in the direction orthogonal to the sheet conveyance direction so as to follow the rotated sheet when the skew correction unit rotates the sheet to correct the skew of the sheet.

11. The sheet conveyance apparatus according to claim 8, wherein the sheet conveyance rolling pairs include a drive roller having a cut portion, and a driven roller which can be brought into the nip with the drive roller, and the sheet conveyance rolling pairs are released from the nip while the cut portion of the drive roller faces the driven roller.

12. An image reading apparatus comprising:

a sheet conveyance apparatus including, a skew correction unit configured to rotate a sheet while conveying the sheet to correct skew of the sheet, and the skew correction unit includes two sheet conveyance rolling pairs independently arranged in the direction orthogonal to the sheet conveyance direction, the skew of the sheet is corrected according to a difference in a sheet conveyance speed between the sheet conveyance rolling pairs;

a lateral registration correction unit which is movable and arranged downstream from the skew correction unit in a direction orthogonal to a sheet conveyance direction, the lateral registration correction unit configured to move in the direction orthogonal to the sheet conveyance direction while holding the conveyed sheet to correct a sheet position; and a sheet conveyance assist unit which is arranged upstream from the skew correction unit, the sheet conveyance assist unit configured to move in the direction orthogonal to the sheet conveyance direction while holding the conveyed sheet, wherein after skew correction of the sheet is performed by the skew correction unit, the sheet conveyance rolling pairs are released from nip, the lateral registration correction unit moves in the direction orthogonal to the sheet conveyance direction while holding the sheet, and the sheet conveyance assist unit moves in a direction of the lateral registration correction unit in synchronization with movement of the lateral registration correction unit while holding the sheet; and an image reading unit configured to read an image of a sheet conveyed by the sheet conveyance apparatus.

13. The image reading apparatus according to claim 12, wherein an amount of movement of the lateral registration correction unit in the direction orthogonal to the sheet conveyance direction which corrects the sheet position, is equal to an amount of synchronized movement of the sheet conveyance assist unit.

14. The image reading apparatus according to claim 12, wherein the sheet conveyance assist unit moves in the direction orthogonal to the sheet conveyance direction so as to follow the rotated sheet when the skew correction unit rotates the sheet to correct the skew of the sheet.

15. The image reading apparatus according to claim 12, wherein the sheet conveyance rolling pairs include a drive roller having a cut portion, and a driven roller which can be brought into the nip with the drive roller, and the sheet conveyance rolling pairs are released from the nip while the cut portion of the drive roller faces the driven roller.

* * * * *